US008726417B2

(12) United States Patent
McLachlan

(10) Patent No.: US 8,726,417 B2
(45) Date of Patent: May 20, 2014

(54) CLAMP ASSEMBLY AND APPAREL CONTAINING SAME

(75) Inventor: Colin A. McLachlan, Sumter, SC (US)

(73) Assignee: E I du Pont de Nemours and Company, Wilmington, DE (US)

( * ) Notice: Subject to any disclaimer, the term of this patent is extended or adjusted under 35 U.S.C. 154(b) by 353 days.

(21) Appl. No.: 13/168,138

(22) Filed: Jun. 24, 2011

(65) Prior Publication Data

US 2012/0324621 A1 Dec. 27, 2012

(51) Int. Cl.
*A41D 19/00* (2006.01)

(52) U.S. Cl.
USPC ..... 2/160

(58) Field of Classification Search
USPC ..... 2/59, 60, 62, 160, 162, 170, 311, 457; 24/483, 484; 36/1, 1.5, 2 R
See application file for complete search history.

(56) References Cited

U.S. PATENT DOCUMENTS

| | | | | | |
|---|---|---|---|---|---|
| 1,377,648 | A * | 5/1921 | Whitaker | 2/158 |
| 3,009,164 | A * | 11/1961 | Frey | 2/270 |
| 3,099,015 | A * | 7/1963 | Renehan | 285/260 |
| 3,744,158 | A * | 7/1973 | Walker | 36/1.5 |
| 4,765,033 | A * | 8/1988 | Hollingsworth | 24/20 CW |
| 6,438,759 | B1 * | 8/2002 | Jaunault et al. | 2/167 |
| 7,225,470 | B1 * | 6/2007 | Bradford | 2/2.11 |
| 7,448,093 | B1 * | 11/2008 | Ruck | 2/457 |
| 2008/0092280 | A1 | 4/2008 | Johnson et al. | |
| 2008/0256677 | A1 | 10/2008 | Loos | |

FOREIGN PATENT DOCUMENTS

WO WO 2005/024250 3/2005

OTHER PUBLICATIONS

Lakeland Industries, Inc; NFPA 1994 Class 2 User's Guide; Level A Manual.

* cited by examiner

*Primary Examiner* — Katherine Moran

(57) ABSTRACT

This invention relates to a clamp assembly useful for attaching together two items of clothing, a garment comprising the clamp assembly, and a process for attaching two items of clothing; the clamp assembly including a circular band and a tubular resilient cover having a hollow body, and wherein the clamp is positioned in the hollow and is encased on all sides by the resilient cover.

9 Claims, 4 Drawing Sheets

CLAMP ASSEMBLY AND APPAREL CONTAINING SAME

BACKGROUND OF INVENTION

1. Field of the Invention

This invention relates to a device useful for attaching of one item of clothing to another item of clothing. It is especially useful in attaching protective gloves to the sleeves of protective garments.

2. Description of Related Art

One method of attaching protective gloves to the sleeves of protective garments involves the use of various rubber bands, a hose clip, and duct tape. Page 6 of the "NFPA 1994 Class 2 User's Guide for DuPont Tychem® Level A Chemical Suits" prepared by Lakeland Industries, Inc. of Decatur, Ala., discloses the very involved steps required to provide such a seal between the glove and the sleeve. Any device that makes the attaching and detaching of items of clothing easier and eliminates the need for rubber bands and duct tape is desirable.

BRIEF SUMMARY OF THE INVENTION

This invention relates to a clamp assembly comprising a clamp including a circular band and a tubular resilient cover having a hollow body, wherein the clamp is positioned in the hollow and is encased on all sides by the resilient cover.

This invention also relates to a garment comprising a glove attached to a sleeve by a clamp assembly, the clamp assembly comprising a clamp including a circular band and a tubular resilient cover having a hollow body, wherein the clamp is positioned in the hollow and is encased on all sides by the resilient cover.

This invention further relates to a process for attaching a first item of clothing to a second item of clothing, each item of clothing comprising at least one material layer, comprising the steps of:

a) providing a support;

b) placing on an outside surface of the support one material layer from the first item of clothing and one material layer from the second item of clothing;

c) applying a clamp assembly to sandwich the first and second material layers together between the support and the clamp assembly, the clamp assembly comprising a clamp including a circular band and a tubular resilient cover having a hollow body, wherein the clamp is positioned in the hollow and is encased on all sides by the resilient cover.

DETAILED DESCRIPTION OF THE INVENTION

This invention relates to a clamp assembly comprising a clamp including a circular band and a tubular resilient cover having a hollow body, wherein the clamp is positioned in the hollow and is encased on all sides by the resilient cover. In some embodiments, this invention relates to a removable clamp assembly for sealing together two items of clothing, the clamp assembly comprising a clamp including a band, a screw housing mounted to the band, and a worm screw disposed in the screw housing for engaging and positioning the band, the clamp encased in a tubular resilient cover, the resilient cover having an opening to operate the worm screw. It is especially useful for sealing protective gloves to the sleeves of protective garments. The clamp assembly can provide a removable leak-proof seal between the glove and sleeve without the use of duct tape or rubber bands. The clamp assembly conceivably has other uses, such as sealing footwear to the legs of a protective garment; or sealing other items of clothing, such as access panels, to the protective garment for other equipment.

Figure 1:
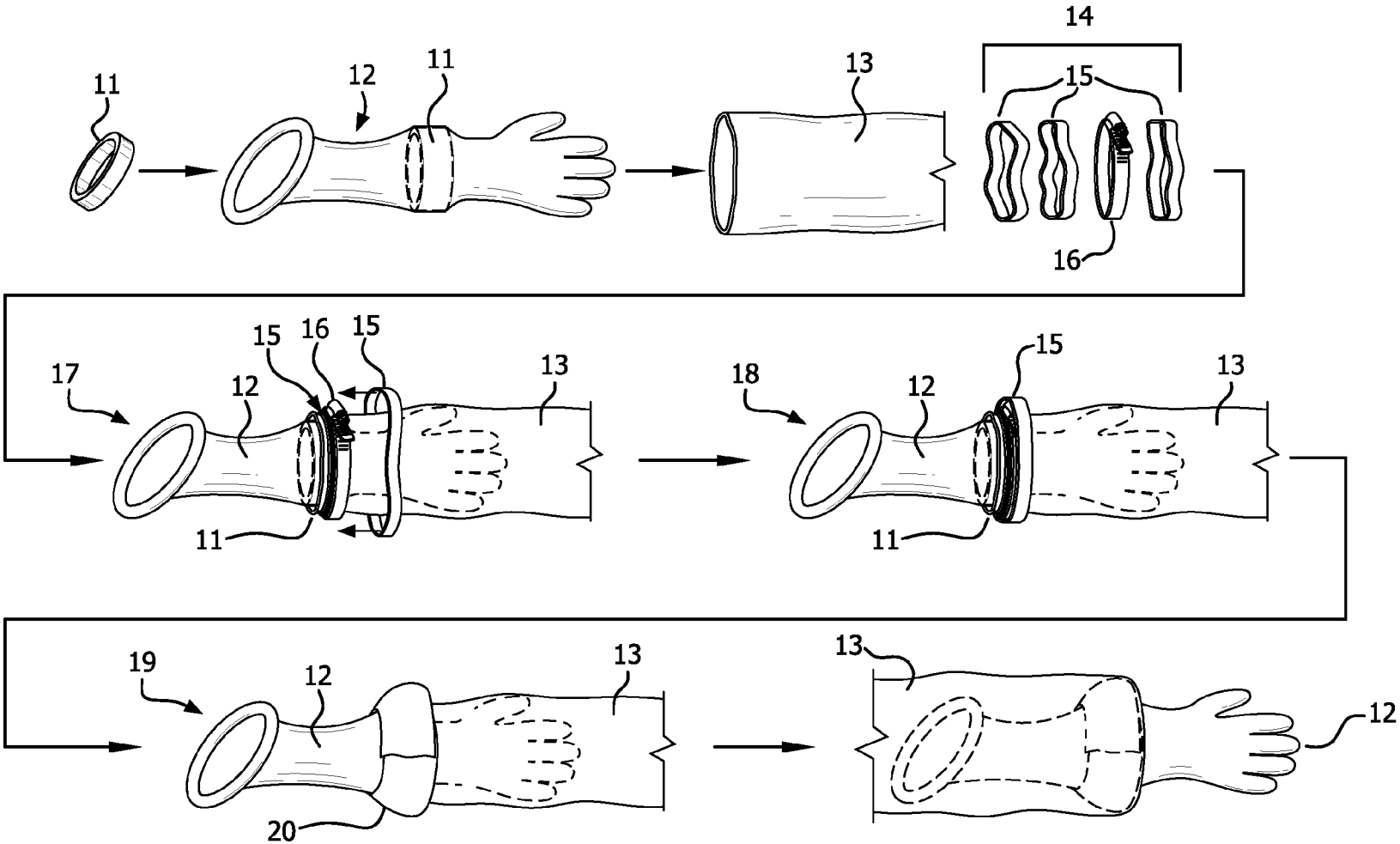
FIG. 1 is a representation of the prior art method for attaching a glove to a sleeve.

FIG. 1 is a representation of the prior art method of attaching a glove to a sleeve. Support ring 11 is inserted into rubber glove 12 as shown, and the fingers of the glove are further inserted into the inverted end of a sleeve 13 of a protective garment. The support ring can be made by cutting a thin ring of about 1 to 3 inches (2.5 to 7.6 cm) in length from rigid PVC tubing having a nominal diameter of from about 3 to 6 inches (7.6 to 15.2 cm); however, any relatively rigid ring could be used. An assortment of attachment devices 14, including rubber bands 15 and hose clip 16 are then used to attach the glove to the sleeve. As shown in 17, one or two rubber bands 15 are first positioned on top of the end of the sleeve 13, compressing the sleeve end onto the rubber glove 12 at the position of the support ring 11. These first one or two rubber bands protect the protective garment fabric from the surface of the hose clip, which is installed over the rubber bands. The hose clip is then tightened to attach the sleeve end to the rubber glove by further compressing the sleeve and glove layers between the hose clip and the support ring. After the hose clip is tightened, normally with a tool (not shown), one or more additional rubber bands 15 then are installed over the hose clip as shown in 18. After the second set of rubber bands 15 are installed, several layers of duct tape 20 are then wrapped around the rubber bands and hose clip as shown in 19 to prevent the rubber bands from shifting off of the hose clip during use of the garment. Finally, the sleeve 13 is re-inverted to expose the glove 12. To detach the glove from the sleeve, or even adjust the glove on the sleeve, the steps must be reversed, inverting the sleeve, followed by removing first the duct tape, then the rubber bands, and then loosening the hose clip with a tool.

Figure 2:
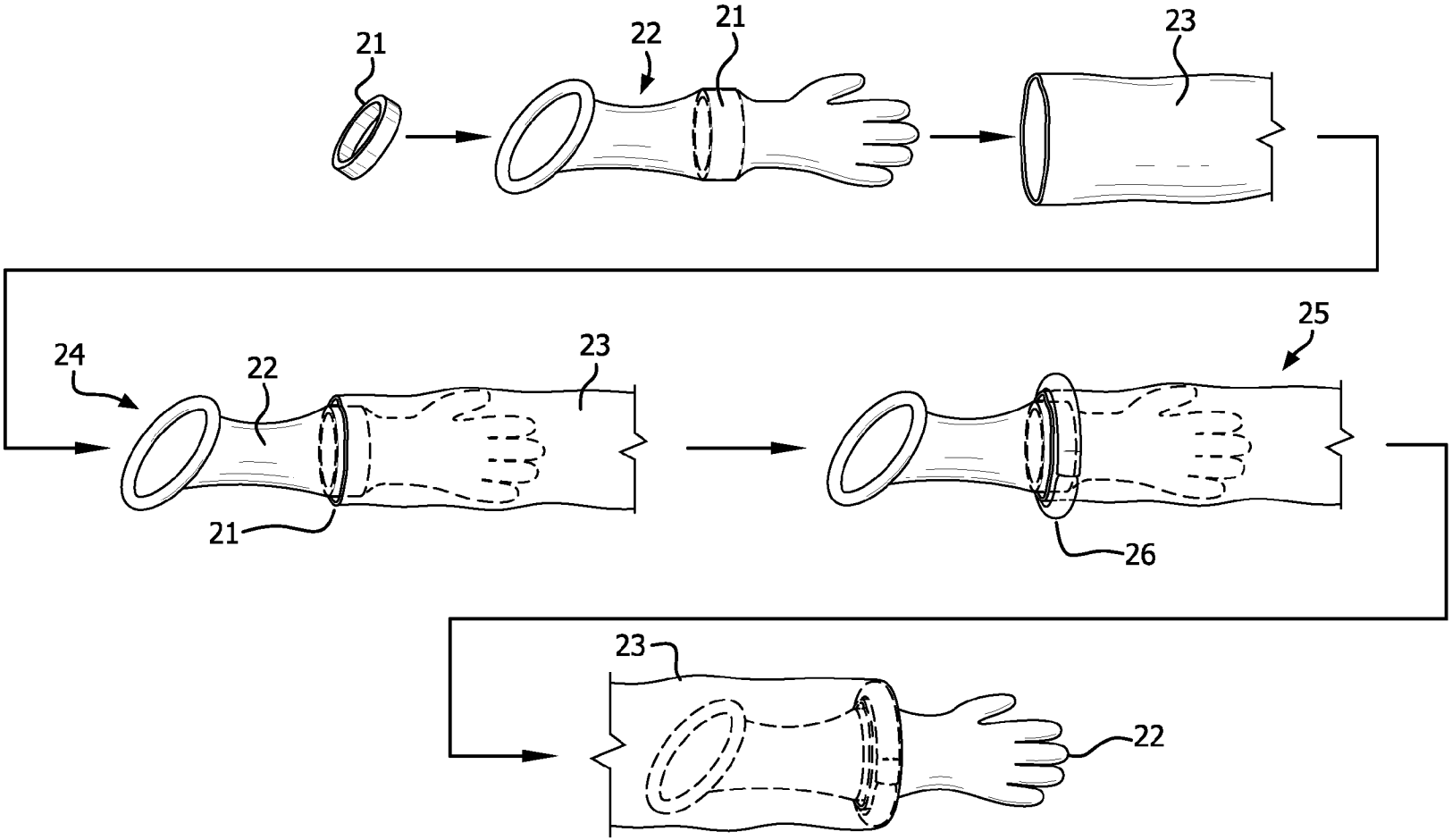
FIG. 2 is a representation of a method for attaching a glove to a sleeve using one version of a clamp assembly described herein.

FIG. 2 is one representation of the use of a clamp assembly for attaching two items of clothing together; in this illustration again a glove is attached to a sleeve. In this illustration, support ring 21 is inserted into rubber glove 22 as shown, and the fingers of the glove are further inserted into the inverted end of a sleeve 23 of a protective garment. The end of the sleeve 23 is then positioned on the rubber glove 22 and adjacent the support ring 21. As shown in 25, clamp assembly 26 comprising a clamp encased on all sides by, and positioned in the hollow of, a tubular sleeve cover is then positioned on top of the end of the sleeve 23 in line with the support ring 21. The clamp is then tightened, normally with a tool, compressing the sleeve and glove layers (along with that part of the cover that is between the sleeve and the clamp) between the clamp in the clamp assembly and the support ring. Finally, the sleeve 23 is re-inverted to expose the glove 22. In the case a removable clamp is used in the clamp assembly, to detach the glove from the sleeve, or adjust the glove on the sleeve, all that is needed is to invert the sleeve and loosen the clamp, again normally using a tool.

Figure 3:
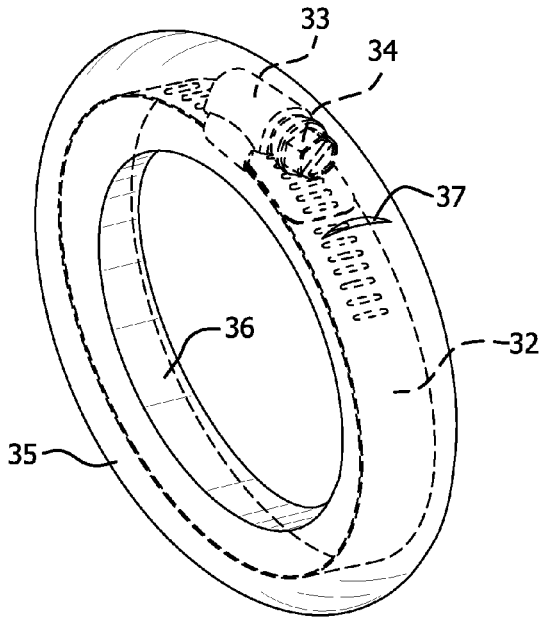
FIG. 3 is a perspective drawing of one version of the clamp assembly using a D-shaped tubular cover.

FIG. 3 is a representation of a preferred clamp assembly 31. This version has the advantage of being removable. It is comprised of a clamp that is preferably a type of hose clip; the clamp includes a band 32, a screw housing 33 mounted to the band and having a worm screw disposed in the screw housing for engaging and positioning the band. The band has a first end that is attached to the screw housing and a second free end having slots; the free end circles around and is inserted into and through the screw housing to form a banded ring, with the threads of the worm screw engaging the slots in the band for positioning the band as desired; i.e., to tighten or loosen the band. The worm screw is typically provided with a slotted and/or hex head 34 for turning the worm screw and tightening and loosening the band.

Figure 4A:
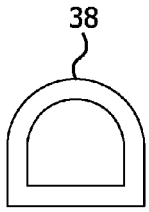
FIGS. 4A, 4B, and 4C are cross-sectional representations of some of the possible tubular covers having a hollow body.
Figure 4B:
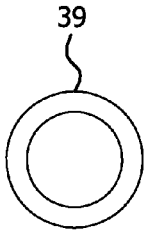
Figure 4C:
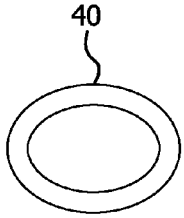

The clamp is encased in a tubular resilient cover 35, the resilient cover having an opening to operate the band via the worm screw. The tubular resilient cover 35 as shown in FIG. 3 can have a D-shaped cross-section, meaning that the interior surface of the cover has a flat surface 36 of a size compatible with the width of the band, as shown by the cross section 38 in FIG. 4A. The tubular resilient cover can have many different shapes including square or rectangular, round, oval or irregular, as in the D-shape. In addition to the most preferred D-shape cross section, other preferred cross-sections include the round cross section 39 shown in FIG. 4B, and the oval cross section 40 shown in FIG. 4C.

In some embodiments, the resilient cover is in the form of a continuous hollow toroidal body of an elastomeric material, and if the clamp requires such, additionally having a small slit for the insertion of a tool to operate the clamp. In some embodiments, the resilient cover is in the form of an elastomeric hollow tube having two ends, with one end inserted into the other to form a hollow toroidal body. In some embodiments the resilient cover is made from an artificial or natural rubber or other elastomeric material. Useful rubber, elastomeric and other materials include those having the following nomenclature from ASTM Standard D1418-06 "Standard Practice for Rubber and Rubber Latices" of: EPDM (terpolymer of ethylene, propylene, and a diene with the residual unsaturated portion of the diene in the side chain); IR (synthetic isoprene); BIIR (bromo-isobutene-isoprene); BR (butadiene); CIIR (chloro-isobutene-isoprene); CR (chloroprene); CSM (chloro-sulfonyl-polyethylene); ECO (ethylene oxide (oxirane) and chloromethyl oxirane (epichlorohydrin copolymer)); EPM (copolymers of ethylene and propylene), FKM (fluoro rubber of the polymethylene type that utilizes vinylidene fluoride as a comonomer and has substituent fluoro, alkyl, perfluoroalkyl or perfluoroalkoxy groups on the polymer chain, with or without a cure site monomer (having a reactive pendant group)); FVMQ (silicone rubber having fluorine, vinyl, and methyl substituent groups on the polymer chain); HNBR (hydrogenated acrylonitrile-butadiene); IIR (isobutene-isoprene), VMQ (silicone rubber having both methyl and vinyl substituent groups on the polymer chain); NBR (acrylonitrile-butadiene); PU (polyurethane), SBR (styrene-butadiene); SEBS (poly[styrene-(block)-ethene-co-butane-(block)-styrene]), SIR (styrene-isoprene rubbers); XNBR (carboxylic-acrylonitrile-butadiene). Other useful materials have the common names of neoprene rubber, butyl rubber, tree rubber, and gum rubber. Other useful materials are known under the trademarks of Viton®, Buna S®, Hypalon®, Silastic®, Kalrez®, Chemraz®, Technoflon®, and others. In some embodiments the resilient cover has a useful shelf life that at least equals and preferably exceeds the shelf life of the fabric used in the garment being sealed, which is typically at least 10 years based on current ASTM standards.

In some embodiments, the resilient cover has a thickness that is preferably at least 0.04 inches (0.10 cm) for the portion compressed between the band of the clamp and the sleeve. In some embodiments the resilient cover has a thickness that is preferably at least 0.06 inches (0.15 cm) for the portion that covers the top of the band, the worm screw, and the worm screw housing. The actual thickness and hardness (durometer) of the resilient cover is selected such that the cover has adequate durability to prevent any abrasion from the clamp to wear through the cover. In some preferred embodiments, the resilient tubular cover is separate from the clamp so that either the cover or the clamp can be replaced individually.

The clamp includes a circular band that can be tightened to compress the resilient cover, and at least two items of clothing together on a support. In some preferred embodiments the circular band can be tightened and loosened. One preferred version is referred to as a hose clip or hose clamp and has a worm screw and screw housing as previously described. For clamps of this type, the band, worm screw, and screw housing are normally made of a durable metal; however, other materials could conceivably be used. Other types of banded clamps can be used, and they need not be easily removable if such functionality is not required. For example, the circular banded clamp could be in the form of the fastener type known as a cable tie, also known as a zip tie and tie-wrap. Such fasteners can include a sturdy nylon tape with an integrated gear rack, which forms the circular band, the fastener further having one pointed end and one end having a type of ratchet within a small open case. Once the pointed tip of the cable tie has been pulled through the case and past the ratchet, forming the circular band, it is prevented from being pulled back; the resulting loop may only be pulled tighter. Such bands would normally have to be cut to be removed, and the opening in the resilient cover could be use to accomplish this.

Other types of banded clamps include, for example, those that can be tightened by crimping; snapper-type clamps; hose clips and other clamps having a quick-release band; "herbie" or "HCL" clips; and hose clamp types designated A, B, C, D, E, and F by the Society of Automotive Engineers Standard J536b that include various tightening mechanisms and bands, including those using one or more wires as the band.

The clamp is positioned in the hollow of the tubular resilient cover and is encased on all sides by that cover. By "encased" it is meant the clamp, including the circular band, is effectively enclosed by or encapsulated by the resilient cover, except for an opening in the cover if needed for the insertion of a tool to operate the band. In a preferred embodiment the clamp including the circular band is a hose clip having a screw housing and worm screw, all positioned in the hollow of the cover and encased on all sides by that cover, having a opening for the insertion of a tool to operate the worm screw.

The presence and size of any opening in the cover is such that it does not compromise the ability of the cover to encase the clamp on all sides and prevent any sharp edges on the clamp from abrading the sleeve or glove. As shown in FIG. 3, this opening can be a slot 37 cut into the resilient cover. Through this slot, a tool, such as an appropriately sized metric or SAE nut driver, can be inserted under the cover to mechanically engage the hex head of the worm screw for tightening or loosening the screw. Alternatively, other types of screw driver can be used, but care must be taken to avoid puncturing the resilient cover or even the protective garment fabric with the tool.

Figure 5:
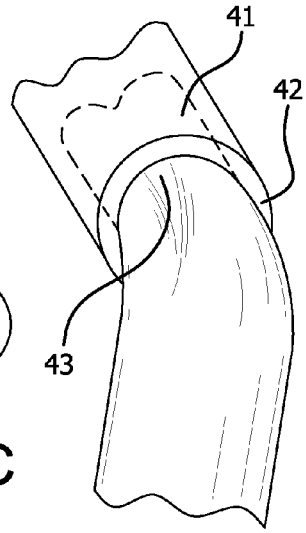
FIG. 5 is a representation of an alternate arrangement of the tubular cover to provide an opening in the cover.

In some embodiments the tubular resilient cover is a continuous hollow tube, except for the opening formed by the slit; in some other embodiments the tubular resilient cover is a tube having first and second ends and the opening in the cover is formed by inserting a first end of the tube into the second end, as shown in FIG. 5. In this embodiment, the tubular resilient cover is in the form of a flexible tube having two opposing ends. One end 41 of the resilient cover is inserted into the other end 42 of the resilient cover an adequate distance to maintain one end within the other end. Because the diameter of the two ends is the same, the surface of the inserted end 41 is slightly bowed or crimped, forming an opening 43, with which a tool could be inserted, for example, to operate the worm screw. In this instance, the clamp can be installed in the hollow of the resilient cover by inserting one end of the band from the clamp into the hollow of the tubular cover, threading the band through the cover and then reattaching the band to form the circular clamp. If the clamp is a hose clip, then similarly the free end of the band is disengaged from the screw housing, and both the band and screw housing are inserted and threaded through the hollow in the tubular cover, and then reattached to form the circular clamp; then one end of the tubular cover is inserted into the other end of the tubular cover to form the completed clamp assembly.

If the resilient cover is provided with a slot, alternatively the slot can be used to assemble the clamp assembly. For example, the clamp including the band and screw housing containing the worm screw can be inserted through the slot in the resilient cover by loosening the band until the free end is backed entirely out of the screw housing, forming an opening in the banded ring. The free end of the band and the screw housing can then be inserted into the slot of the resilient cover, and threaded around the annular space. The free end is then inserted back into the screw housing and the worm screw tightened to re-form the banded clamp inside the resilient cover. A cable-tie like clamp could also be installed in a similar manner without requiring the use of a tool.

Figure 6:
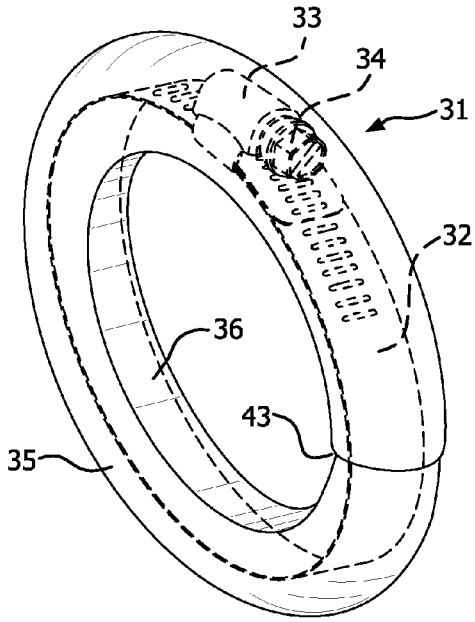
FIG. 6 is a perspective drawing of one version of the clamp assembly using the cover arrangement illustrated in FIG. 5.

FIG. 6 is a representation of one type of a preferred a clamp assembly 31 using the cover arrangement illustrated in FIG. 5. FIG. 6, like FIG. 3, is comprised of a clamp that is preferably a type of hose clip; the clamp includes a band 32, a screw housing 33 mounted to the band and having a worm screw disposed in the screw housing for engaging and positioning the band. The band has a first end that is attached to the screw housing and a second free end having slots that circles around and is inserted into and through the screw housing to form a banded ring, with the threads of the worm screw engaging the slots in the band and positioning the band as desired to tighten or loosen the band. The worm screw is typically provided with a slotted hex head 34 for turning the worm screw and tightening and loosening the band.

Regardless of the form the opening takes, the opening is preferably conveniently located or positioned such that the clamp can be operated with a tool. Further, care is taken to ensure the slot is positioned such that the free end or any portion of the band does not extend through the opening. In a preferred embodiment, the opening is positioned between the free end of the band and the screw housing in the case of a hose clip; or between the free end of the band and ratchet in the case of a cable-tie like band.

This invention also relates to a garment comprising a glove attached to a sleeve by a clamp assembly, the clamp assembly comprising a clamp including a circular band and a tubular resilient cover having a hollow body wherein the clamp is positioned in the hollow and is encased on all sides by the resilient cover. In some embodiments, the garment is a protective garment comprising a glove attached to a sleeve by a removable clamp assembly, the clamp assembly comprising a clamp including a band, a screw housing mounted to the band, and a worm screw disposed in the screw housing for engaging and positioning the band, the clamp encased in a tubular resilient cover, the resilient cover having an opening to operate the worm screw.

In some preferred embodiments the sleeve is a part of a Level A, B, C or D protective garment. Level A garments are used in situations that require the highest level of skin, respiratory, and eye protection, and are generally totally encapsulating vapor protective garments. Level B garments are used in situations that require the highest level of respiratory protection but a lesser level of skin protection is needed. Level C garments are used in situations where atmospheric contaminants, liquid splashes, and other direct contact will not adversely affect or be absorbed by any exposed skin. Level D garments are used in situations where contamination is only a nuisance. There may be some instances where combinations of protective apparel rated for A, B, C, or D level may be used together.

In some embodiments the sleeve is part of an encapsulating chemical-resistant suit, in some embodiments it is part of coveralls, or part of any type of shirt or coat or pants or combination garment. Useful gloves include chemical resistant gloves made of materials such as the rubbers and elastomeric materials previously cited for the resilient cover, along with such materials as polyvinyl alcohol and polyvinylchloride. If desired, the glove can include a chemical resistant liner in the form of proprietary protective garment fabrics, barrier fabrics, laminates, and films; and this liner is sealed along with the glove and the sleeve with the clamp assembly. The material forming the sleeves in these garments can vary widely and can include nonwovens and woven fabrics and laminates of such materials with films. In some preferred embodiments the sleeve and garment material is a multilayer film and nonwoven laminate.

Figure 7:
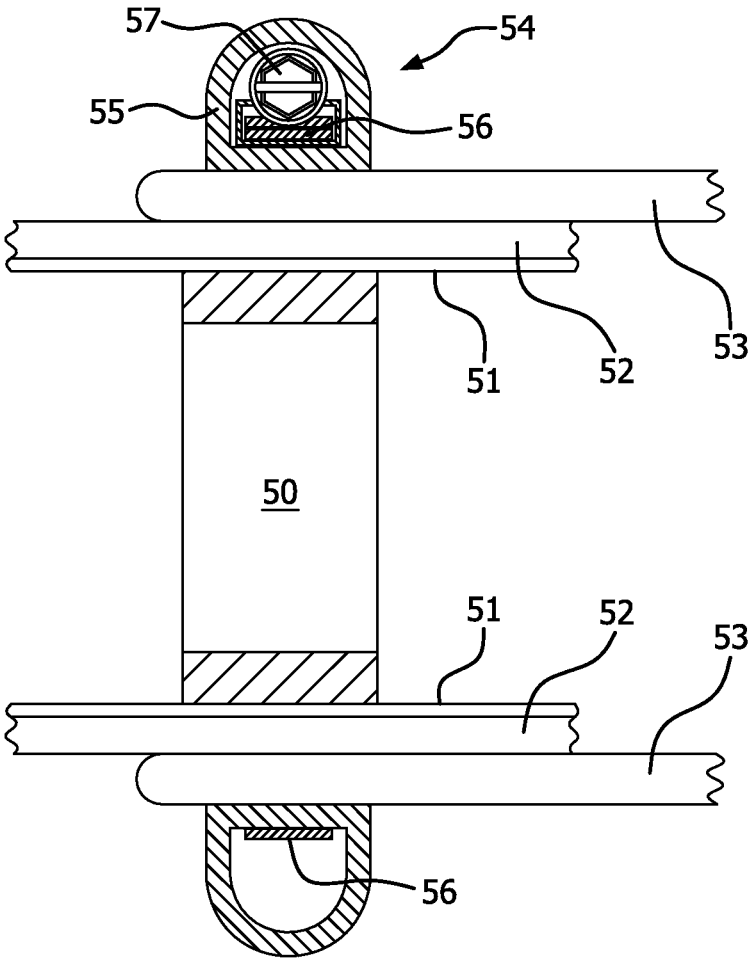
FIG. 7 is a cross-sectional view of one type of clamp assembly installed on a support, sealing at least two items of clothing.

FIG. 7 is one possible cross-sectional representation of the clamp assembly installed as generally represented by 25 in FIG. 2. Support ring 50 is positioned inside both rubber glove 52 and a chemical protective liner 51 as shown. The end of sleeve 53 of a protective garment is adjacent and generally aligned with the support ring, with some overlap. The clamp assembly 54 comprises a clamp, including a band 56 and screw housing with hex head worm screw 57 mounted to the band. The clamp is encased in the hollow of tubular resilient cover 55 having a D-shaped cross-section, the straight side of the cover forming the innermost surface. The clamp assembly is positioned on top of the end of the sleeve 53 in line with the support ring 50. After the clamp assembly is installed and tightened, the sleeve 53 is then inverted over the clamp assembly as shown in the last step in FIG. 2. All of the other features of the clamp assembly previously discussed herein can be used with the garment containing the clamp assembly.

This invention further relates to a process for attaching a first item of clothing to a second item of clothing, each item of clothing comprising at least one material layer, comprising the steps of:

a) providing a support;

b) placing on an outside surface of the support one material layer from the first item of clothing and one material layer from the second item of clothing;

c) applying a clamp assembly to sandwich the first and second material layers together between the support and the clamp assembly, the clamp assembly comprising a clamp including a circular band and a tubular resilient cover having a hollow body, wherein the clamp is positioned in the hollow and is encased on all sides by the resilient cover.

In some embodiments, the invention relates to a process of removably sealing a first item of clothing to a second item of clothing, each item of clothing comprising at least one material layer, comprising the steps of, a) providing a support;

b) placing on an outside surface of the support one material layer from the first item of clothing and one material layer from the second item of clothing;

c) applying a removable clamp assembly to sandwich the two material layers between the support and the clamp assembly, the clamp assembly comprising a clamp including a band, a screw housing mounted to the band, and a worm screw disposed in the screw housing for engaging and positioning the band, the clamp encased in a tubular resilient cover, the resilient cover having an opening to operate the worm screw, and d) operating the worm screw to tighten the clamp and compress the two material layers together between the support and the removable clamp assembly.

In some preferred embodiments, the first or second item of clothing is a glove and the other item of clothing is a sleeve for a chemical protective garment as previously disclosed. In some embodiments other layers of materials, for example, such as a liner, can be combined and clamped with the first and second materials.

The various items used in this process, such as the support ring, the various material layers, and the clamp assembly are the same as previously disclosed herein. In some preferred embodiments, the tubular resilient cover has a D-shaped cross-section. In some preferred embodiments, the tubular resilient cover has a slit positioned such that the worm screw can be operated with an inserted tool. In some embodiments the tubular resilient cover is a continuous tube, except for the slit; while in some other embodiments the tubular resilient cover is a tube having first and second ends and the opening in the cover is formed by inserting a first end of the tube into the second end.

EXAMPLE 1

This is an example of the process of removably sealing a material layer of a first item of clothing to a material layer of a second item of clothing. A glove liner is inserted into a neoprene glove. An approximately 1-inch long ring of 4" diameter PVC is then inserted into the dual gloves, inside the glove liner, to form a glove assembly. The ring is slid into the gauntlet of the glove assembly to approximately 3" from the base of the thumb. A hand is then fully extended into the glove, inside the liner, until all the finger stalls are filled. With the glove assembly on the hand, a fist is formed and the glove assembly is adjusted to make sure the liner and the neoprene glove are suitably matched, any excess air trapped between the liner and glove is expelled, and the PVC ring is properly positioned. The hand is then removed, taking care to not dislodge the liner from its place in the glove. The finished glove assembly has a bulge where the PVC ring is positioned.

A clamp assembly is formed as follows. A clamp that is a 4" hose clip is inserted into a continuous tubular rubber tube having a D-shape cross-section and a slot cut into the rounded surface of the tube. The hose clip is inserted by loosening the band of the hose clip until the free end is backed entirely out of the screw housing, forming an opening in the banded ring. The free end of the band and the screw housing are then inserted into the slot of the continuous tubular rubber tube, and threaded through and around the annular space until the free end comes back in contact with the screw housing. The free end is then inserted back into the screw housing and the worm screw tightened to re-form the banded clamp inside the resilient cover. The slot in the tube is positioned so that the worm screw and be tightened with an inserted tool.

The glove assembly and sleeve are then attached by the clamp assembly as follows: The sleeve of a protective garment is fully inverted inside out. The fingers end of the glove assembly is then inserted into the end of the inverted sleeve until the bulge in the glove assembly formed by the PVC ring is fully inserted into the end of the sleeve and lines up with the end of the sleeve. The clamp assembly is then slipped over the sleeve end, adjusting the clamp assembly to have a wider diameter if needed to fit over the combined sleeve and glove. The clamp assembly is positioned in line with the PVC ring in the glove assembly, with the sleeve and glove assembly layers positioned between the clamp assembly and the PVC ring. A nut driver is then inserted into the clamp assembly through the slit in the continuous rubber tube and the hose clip is tightened to seal the sleeve to the glove assembly. The sleeve is then re-inverted to expose the fingers of the glove. The other sleeve of the garment is then sealed to a glove assembly in a similar manner.

The clamp assembly provides a removable leakproof seal between the glove and sleeve without the use of duct tape or rubber bands.

EXAMPLE 2

Example 1 is repeated with an alternate clamp assembly formed from a rubber tube having two opposing ends. The hose clip is installed by disengaging the free end of the band from the screw housing, inserting and threading the band and screw housing into the rubber tube, and then reattaching the band to the screw housing. Then one end of the rubber tube is inserted and wedged into the other end of the rubber tube. The entire rubber tube covering is then slid until the insertion point of one end into the other is positioned such that a tool can be inserted to operate the worm gear.

What is claimed is:

1. A clamp assembly, comprising:

i) a clamp including a circular band that can be tightened and loosened; and ii) a tubular resilient cover having a hollow body, wherein the clamp is positioned in the hollow and is encased on all sides by the resilient cover; and wherein the tubular resilient cover comprises artificial or natural rubber and is compressed when the circular band is tightened;

wherein the cover has an opening for operating the clamp; and wherein the clamp includes a screw housing mounted to the band, and a worm screw disposed in the screw housing for engaging and positioning the band.

2. The clamp assembly of claim 1 wherein the opening is a slit in the tubular resilient cover.

3. The clamp assembly of claim 1 wherein the tubular resilient cover is a tube having first and second ends and the opening in the cover is formed by inserting a first end of the tube into the second end.

4. The clamp assembly of claim 1 wherein tubular resilient cover has a D-shaped cross-section.

5. A garment comprising a glove layer attached to a sleeve layer by a clamp assembly and a support ring, the clamp assembly comprising i) a clamp including a circular band; and ii) a tubular resilient cover having a hollow body, wherein the clamp is positioned in the hollow and is encased on all sides by the resilient cover; and wherein the clamp compresses the sleeve layer and glove layer between the clamp assembly and the support ring;

wherein the cover has an opening for operating the clamp; and wherein the clamp includes a screw housing mounted to the band, and a worm screw disposed in the screw housing for engaging and positioning the band.

6. The garment of claim 5 wherein the opening is a slit in the tubular resilient cover.

7. The garment of claim 5 wherein the tubular resilient cover is a tube having first and second ends and the opening in the cover is formed by inserting a first end of the tube into the second end.

8. The garment of claim 5 wherein tubular resilient cover has a D-shaped cross-section.

9. A process for attaching a first item of clothing to a second item of clothing, each item of clothing comprising at least one material layer, comprising the steps of:

a) providing a support;

b) placing on an outside surface of the support one material layer from the first item of clothing and one material layer from the second item of clothing;

c) applying a clamp assembly to sandwich the first and second material layers together between the support and the clamp assembly, the clamp assembly comprising a clamp including a circular band and a tubular resilient cover having a hollow body, wherein the clamp is positioned in the hollow and is encased on all sides by the resilient cover, and wherein the resilient cover has an opening for operating and accessing the clamp and the clamp includes a screw housing mounted to the band and a worm screw disposed in the screw housing for engaging and positioning the band.

* * * * *